US007611391B2

(12) United States Patent
Long et al.

(10) Patent No.: US 7,611,391 B2
(45) Date of Patent: Nov. 3, 2009

(54) BATTERY CONNECTOR

(75) Inventors: Ji-En Long, ShenZhen (CN); Wei-Nan Kuo, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 154 days.

(21) Appl. No.: 11/906,407

(22) Filed: Oct. 1, 2007

(65) Prior Publication Data

US 2008/0081495 A1 Apr. 3, 2008

(51) Int. Cl.
*H01R 4/48* (2006.01)

(52) U.S. Cl. ..... 439/862; 439/500

(58) Field of Classification Search ..... 439/733.1, 439/752, 500, 862
See application file for complete search history.

(56) References Cited

U.S. PATENT DOCUMENTS 6,851,986 B2 * 2/2005 Zhao ..... 439/744
7,517,261 B2 * 4/2009 Wan et al. ..... 439/862

* cited by examiner

*Primary Examiner*—Khiem Nguyen
(74) *Attorney, Agent, or Firm*—Ming Chieh Chang; Wei Te Chung; Andrew C. Cheng

(57) ABSTRACT

A battery connector includes an insulating housing and a plurality of electrical terminals. The insulating housing has a top mating wall, a front wall, a rear wall and a plurality of vertical walls extend downward from the top mating wall, wherein a plurality of terminal receiving chambers are formed between each pair of the vertical, and the top mating wall has a plurality of openings respectively communicating with the terminal receiving chambers for penetrating through the terminal receiving chambers, and two opposite ends of each opening in the top mating face defines a plurality of stand-offs. The electrical terminals respectively received in the terminal receiving chambers, the electrical terminals each having a body, a conducting portion, a resilient portion, and a contacting portion, wherein the contacting portion out of the opening of the top mating wall and tower over the stand-off. With this design, the stand-offs can limit the downward movement of the contacting portions of the electrical terminals.

9 Claims, 5 Drawing Sheets

3

BATTERY CONNECTOR

BACKGROUND OF THE INVENTION

1. Field of the Invention

The present invention relates to a battery connector, more particularly to a battery connector for handset or portable electrical device.

2. Description of Prior Arts

In normal electronic devices, such as a cell phone, usually uses a battery connector to provide an electrical connection between one of the electronic devices and a battery.

The FIG. 1 discloses a conventional battery connector 100', comprising an insulating housing 2' and a plurality of electrical terminals 3'. The insulating housing 2' has a top mating wall 21', a front wall 22', a rear wall 23', a plurality of vertical walls 24' arranged alternatively on the top mating wall 21', and a plurality of terminal receiving chambers 25' relatively formed between each of pairs the vertical walls 24'. The electrical terminals 3' are respectively received in the terminal receiving chambers 25', and the electrical terminals 3' each has a body 311', a conducting portion 32', a resilient portion 33', and a contacting portion 34'. The conducting portion 32' extends from a first end of the body 31', the resilient portion 33' extends upwardly from a second end of the body 31', and the contacting portion 34' connects one end of the resilient portion 33', which has another end connects to the body 31'. The electrical terminals 3' respectively orients in the terminal receiving chambers 25', the conducting portion 32' exposes below and extends outwardly from the rear wall 23' thereof, and the contacting portion 34' is located outwardly from the top mating wall 21'. In practical use, a battery (No shown) connects with the contacting portion 34' of the battery connector 100' and the battery will inflict an excess force on the resilient portion 33'. Therefore, the resilient portion 33' of the electrical terminal 3' tends to twist under pressure and maybe can reduce the working life after the battery connector 100' use some time.

Hence, an improved battery connector is desired to overcome the disadvantages and problems of the prior art.

SUMMARY OF THE INVENTION

Accordingly, it is an object of the present invention to provide a battery connector in order to increase the working life to a complementary connector.

In order to achieve the above mentioned objects, a battery connector in accordance with a preferred embodiment of the present invention includes an insulating housing and a plurality of electrical terminals. The insulating housing has a top mating wall, a front wall, a rear wall and a plurality of vertical walls extend downward from the top mating wall, wherein a plurality of terminal receiving chambers are formed between each pair of the vertical walls, and the top mating wall has a plurality of openings respectively communicating with the terminal receiving chambers for penetrating through the terminal receiving chambers, and two opposite ends of each opening on the top mating face defines a plurality of stand-offs. The electrical terminals respectively received in the terminal receiving chambers, the electrical terminals each having a body, a conducting portion, a resilient portion, and a contacting portion, wherein the contacting portion out of the opening of the top mating wall and tower over the stand-off. With this design, the stand-offs can limit the downward movement of the contacting portions of the electrical terminals.

Other objects, advantages and novel features of the invention will become more apparent from the following detailed description of the present embodiment when taken in conjunction with the accompanying drawings.

BRIEF DESCRIPTION OF THE DRAWING

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
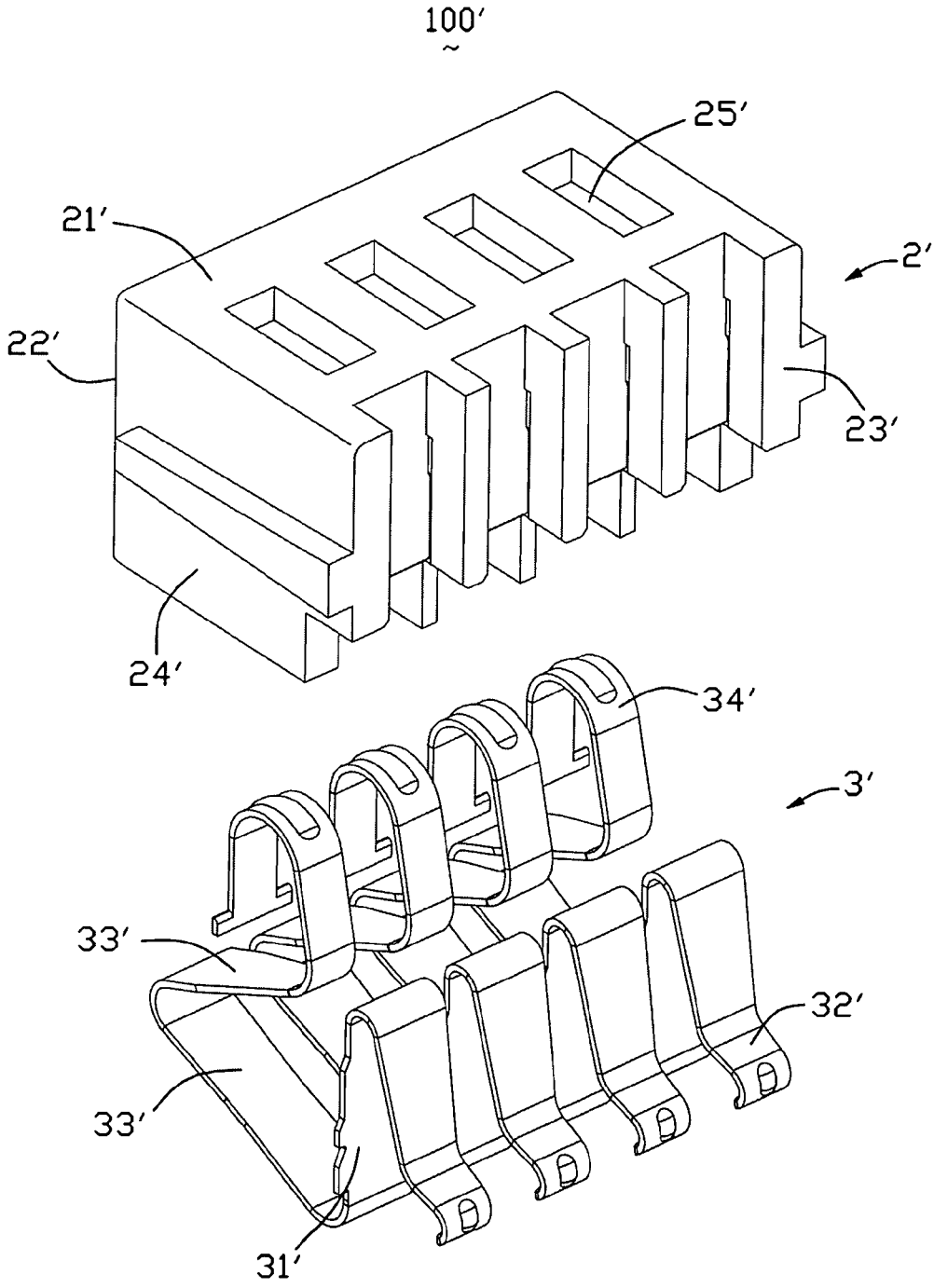
FIG. 1 (PRIOR ART)
FIG. 1 is a prospective view of a battery connector of the prior art.

While the invention may be embodied in different forms, there is shown in the drawings, and herein will be described in detail, specific embodiments with the understanding that the present disclosure is to be considered an exemplification of the principles of the invention, and is not intended to limit the invention to that as illustrated and described herein.

Figure 2:
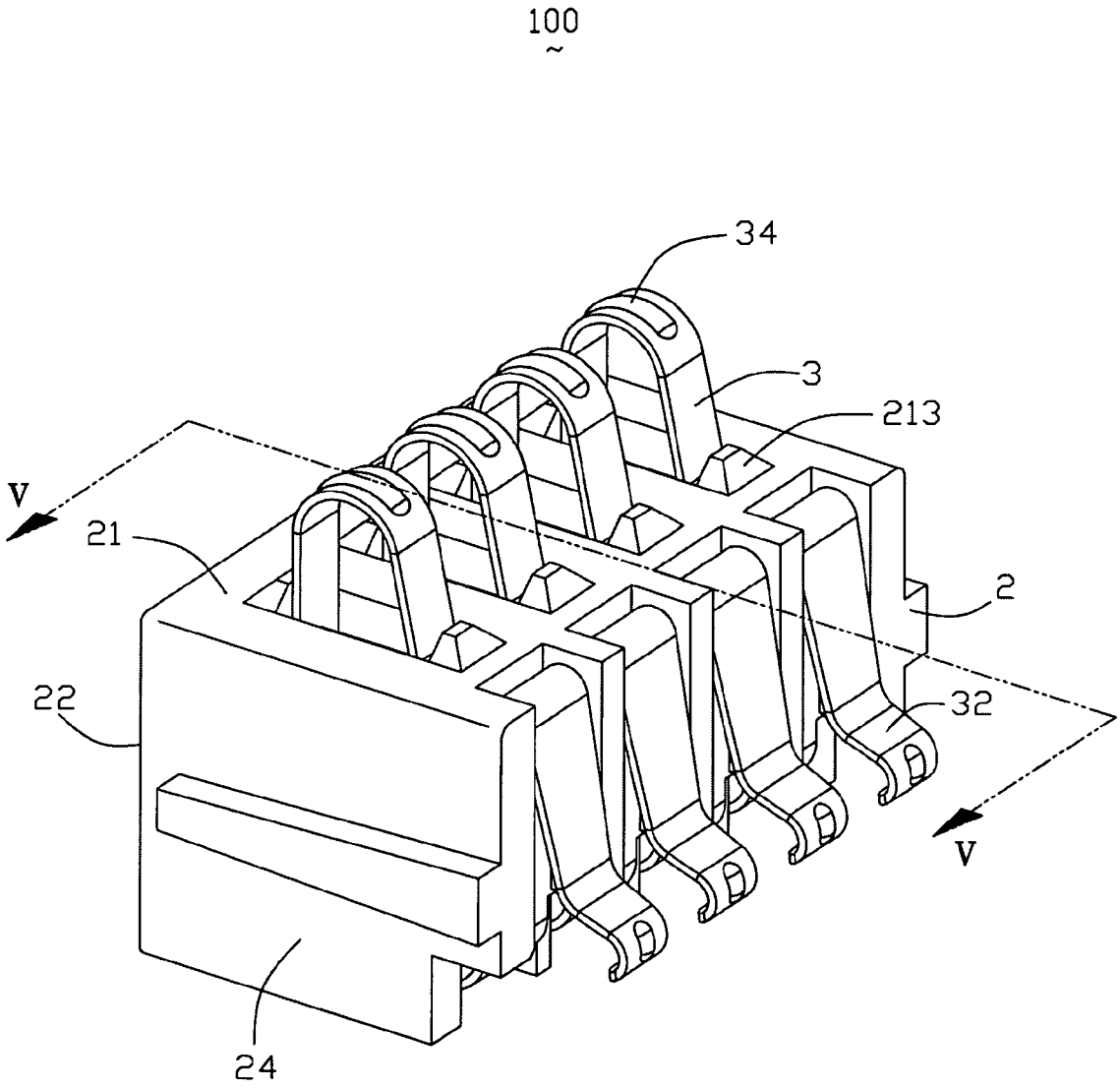
FIG. 2 is a prospective view of a battery connector of the present invention.
Figure 3:
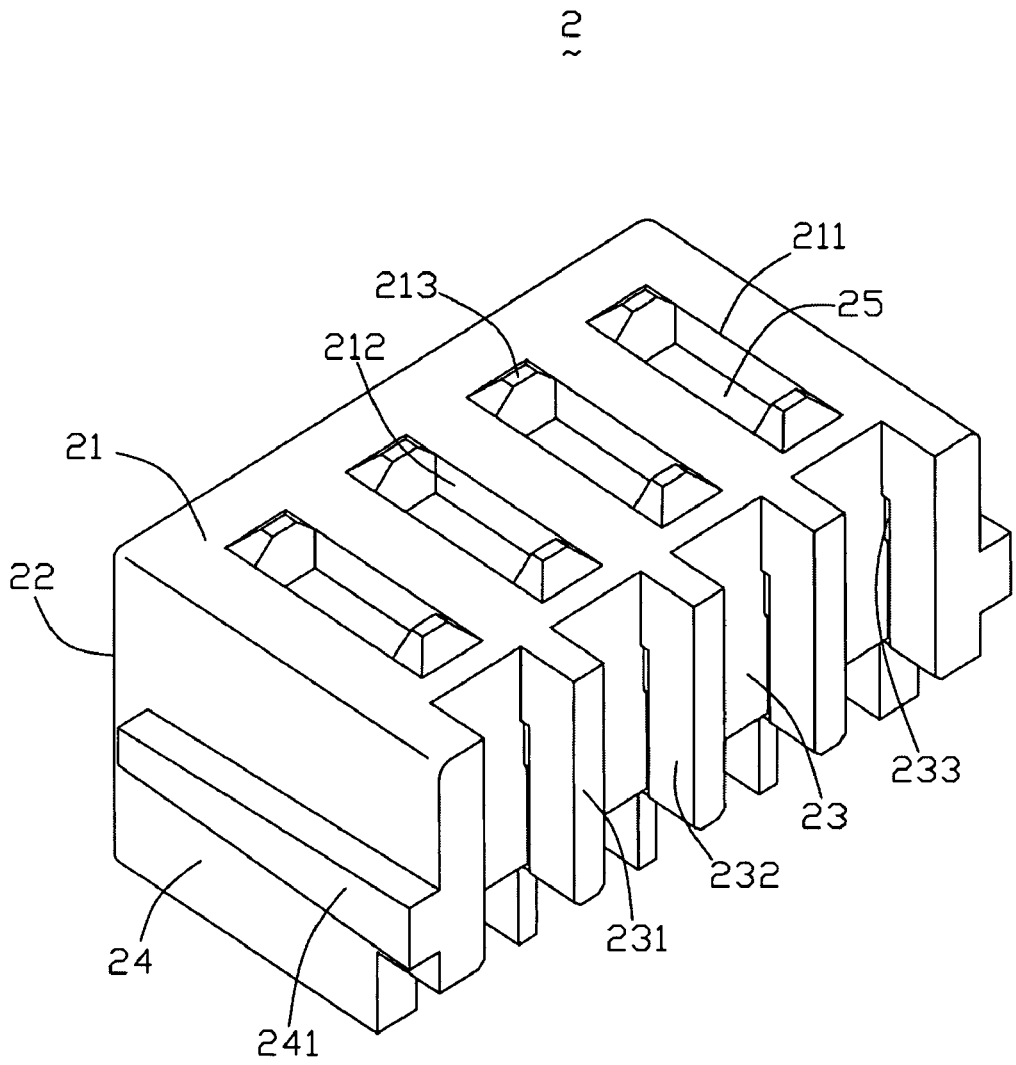
FIG. 3 is a perspective view of an insulating housing of the battery connector shown in FIG. 2.

Referring to the FIG. 2 and FIG. 3, the present invention provides a battery connector 100 assembling to a printed circuit board of a cell phone for electrically mating to a corresponding joint, electrically connecting to a battery in the cell phone. The battery connector 100 includes an insulating housing 2 and a plurality of electrical terminals 3, wherein the insulating housing 2 is a vertical housing and has a top mating wall 21, a front wall 22, a rear wall 23, a plurality of vertical walls 24 arranged alternatively on the top mating wall 21, and a plurality of terminal receiving chambers 25 relatively formed between each of pairs the vertical walls 24, the top mating wall 21 has a plurality of openings 211 respectively communicating with the terminal receiving chambers 25 for penetrating through the terminal receiving chambers 25. Each pair of the vertical walls 24 sandwiching one of the terminal receiving chambers 25. A pair of ledges 212 projects oppositely between the crossover sides of the opening 211 and the vertical walls 24. Two opposite ends of each opening 211 in the top mating face 21 defines a plurality of stand-offs 213, or the stand-offs 213 can be set on the top mating face 21 anywhere. Besides, the rear wall 23 of the insulating housing 2 has a plurality of ribs 231 integrally backwardly extending thereof and respectively corresponding to the vertical walls 24, and a receiving groove 232 formed between the rear wall 23 and the ribs 231, and a plurality of limiting grooves 233 formed in the crossover sides of the rear wall 23 and the ribs 231. The two outermost vertical walls 24 thereof respectively expose outwardly a clamping block 241 for orienting with a housing of the electronic device while the battery connector 100 assemblies to the electronic device.

Figure 4:
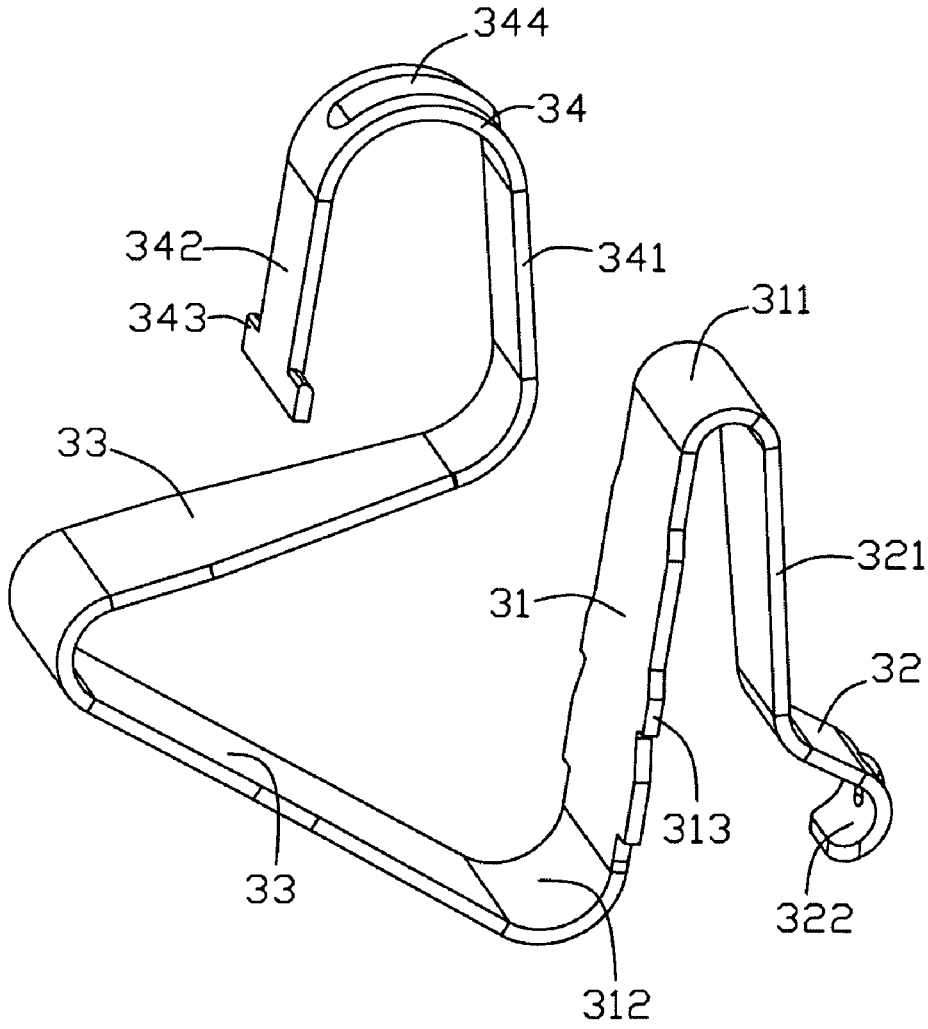
FIG. 4 is a perspective view of a electrical terminal of the battery connector shown in FIG. 2.
Figure 5:
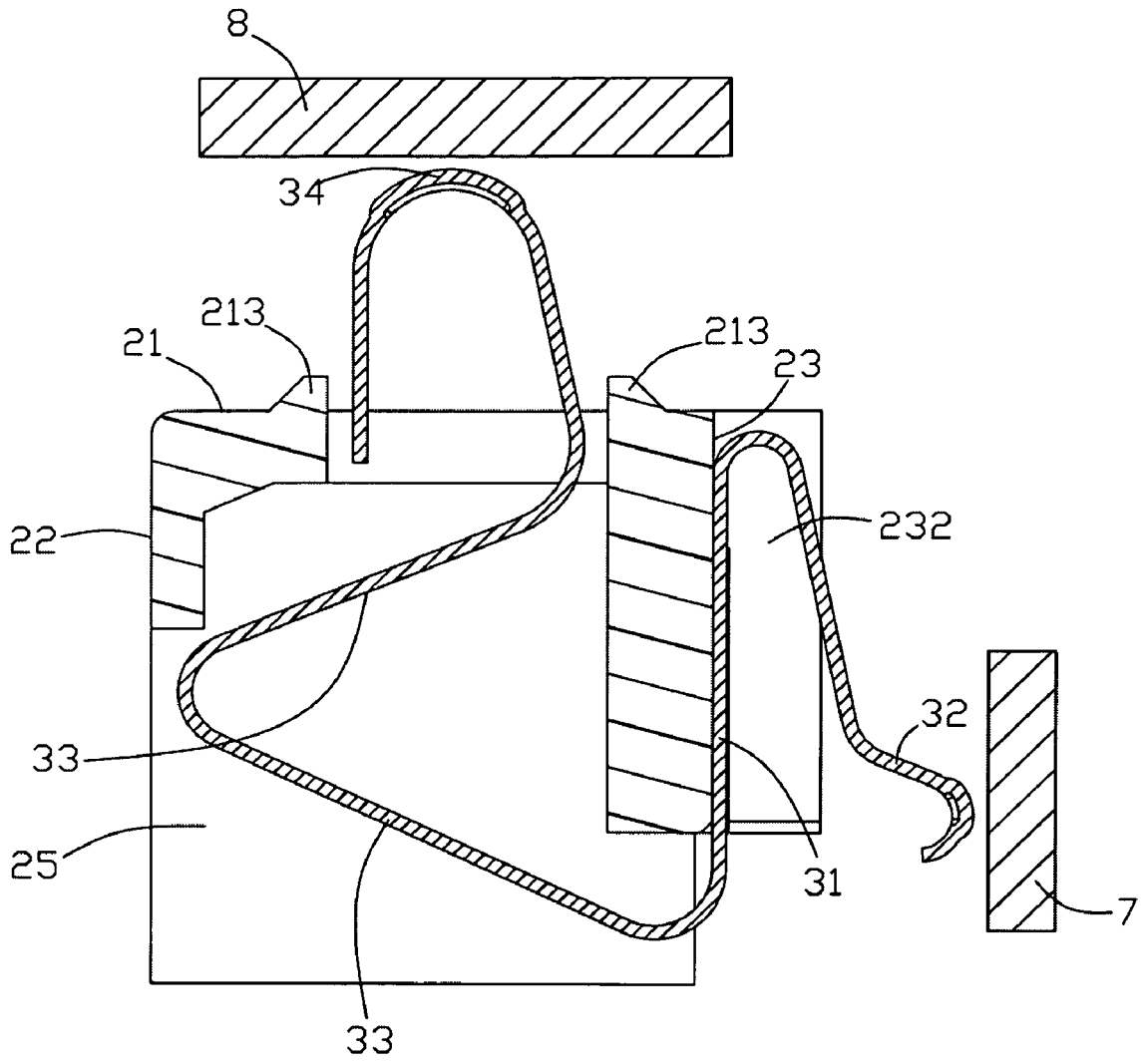
FIG. 5 is a cross-sectional view along line V-V of FIG. 2 to the present invention battery connector connecting a PCB.

Each of the electrical terminals 3 is respectively received in the corresponding terminal receiving chambers 25. Each of the electrical terminals 3 is a flexuous terminal and has a body 31, a conducting portion 32, a resilient portion 33, and a contacting portion 34 (please referring to the FIG. 4 at the same time), wherein the body 31 is a rectangular sheet disposed longitudinally and has a first side 311 and a second side 312 opposing to the first side 311. The conducting portion 32 is formed by an extension downwardly tilting extending from the first side 311 and in a hook shape. The conducting portion 32 has a first portion 321 tilting downwardly and a second portion 322 integrally extending from the first portion 321, the first portion 321 and the second portion 322 cross to press a joint on a printed circuit board 7 (referring to the FIG. 5). Besides, the body 31 has a plurality of teeth 313 at the opposite edges for mounting in the limiting grooves 233 of the housing.

The resilient portion 33 extends from the second side 312 of the body 31 integrally and extends crookedly upwardly, the resilient portion 33 formed a V-shaped and has a Λ-shaped contacting portion 34 integrally connecting to an end of the resilient portion 33, the contacting portion 34 has a first arm 341 and a second arm 342, the first arm 341 integrally upwardly extends from an end of the resilient portion 33 first and then bent a sharp with a generally "Λ" shape extends laterally integrally to form the second arm 342. A pair of wings 343 defined at the free end of the second arm 342 and controls the height of the contacting portion 34, which out of the opening 211. A contact point 344 is located between the first arm 341 and the second arm 342, preferably at the point of the generally "Λ" shape.

In assembly, the electrical terminals 3 respectively insert into corresponding terminal receiving chambers 25. The terminal body 31 is located in the receiving grooves 232. After assembly, the body 31 of each of electrical terminals 3 is oriented in each of receiving grooves 232 by suppressions with the plurality of limiting grooves 233 and interferences with the plurality of teeth 313. The conducting portion 32 out of the receiving groove 232. After assembling to the electronic device (No Shown), the conducting portion 32 electrically connecting to the PCB 7 and further the conducting portion 32 locates in the receiving groove 232, which has the ribs 231, to limit a displacement of the conducting portion 32 and avoid the imperfect contact between the conducting portion 32 and the PCB 7.

The contacting portion 34 out of the top mating wall 21 from the terminal receiving chamber 25, a battery 8 aligns locations of the electrical terminals 3 from a top of the battery connector 100 and moves to a bottom thereof to suppress a corresponding terminals on the contacting portion 34 while the battery connector 100 electrical connects the battery 8. Because of the corresponding terminals retains the contacting portion 34 to the bottom thereof to drive the resilient portion 33 constricting from a top to a bottom in the terminal receiving chamber 25, and the resilient portion 33 has a contacting resistance generating by the elastic recovery to drive the contacting portion 34 moving upwards to tightly the corresponding terminals to electrically connects the battery connector 100 to the battery 8. During above-mentioned process, the stand-offs 213 of the housing have an important action, the height of the stand-offs 213 is lower than the portion of the contacting portion 34 out of the top mating wall 21. With this design, the stand-offs 213 can limit the downward movement of the contacting portion 34 of the electrical terminals 3 and relieve a pressing force to the contacting portion 34.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claim is:

1. A battery connector comprising:

an insulating housing has a top mating wall, a front wall, a rear wall and a plurality of vertical walls extend downward from the top mating wall, wherein a plurality of terminal receiving chambers are formed between each pair of the vertical walls, and the top mating wall has a plurality of openings respectively communicating with the terminal receiving chambers for penetrating through the terminal receiving chambers, and two opposite ends of each opening on the top mating face defines a plurality of stand-offs;

a plurality of electrical terminals respectively received in the terminal receiving chambers, the electrical terminals each having a body, a conducting portion, a resilient portion, and a contacting portion; and wherein the contacting portion out of the opening and tower over the stand-off.

2. The battery connector of claim 1, wherein the rear wall has a plurality of ribs extending backwardly integrally under thereof and respectively corresponding to the vertical walls, which are adjacent to each other, and a receiving groove formed between two of the ribs, the body locates in the receiving groove.

3. The battery connector of claim 2, wherein the electrical terminals orients in the corresponding terminal receiving chambers, the conducting portion locates under and out of the receiving groove.

4. The battery connector of claim 3, wherein the body has a first side and a second side opposing to the first side, the conducting portion extends from the first side, the resilient portion has an end connecting the second side upwardly, the contacting portion connects an other end of the resilient portion.

5. The battery connector of claim 4, wherein the contacting portion has a first arm and a second arm, the first arm integrally upwardly extends from an end of the resilient arm first and then extends downwardly integrally to form the second arm.

6. The battery connector of claim 5, wherein a contact point is located between the first arm and the second arm, preferably at the point of the generally "Λ" shape.

7. The battery connector of claim 6, wherein a pair of wings defined at the free end of the second arm.

8. The battery connector of claim 7, wherein the insulating housing has two outermost vertical walls respectively two clamping blocks exposing outwardly thereof.

9. A battery connector, comprising: an insulating housing defining a first mating face and a second mating face adjacent to each other, and a bottom surface opposite to the first mating face, a plurality of ribs formed on the second mating face defining a plurality of grooves, a plurality of passageways extending from the bottom surface toward the first mating surface, each passageway arranged corresponding to the corresponding groove; a plurality of contact terminals each including a base portion securely positioned within the corresponding groove, each contact terminals including a first mating portion extending from the base portion and out of the first mating surface, and a second mating portion extending also from the base portion and away from the groove; and at least one stand-off arranged on the first mating surface; and wherein the stand-offs are provided adjacent to openings of the insulating housing.

* * * * *